United States Patent [19]

Brown et al.

[11] Patent Number: 4,715,424

[45] Date of Patent: Dec. 29, 1987

[54] BREAKER PAD

[75] Inventors: Alan P. B. Brown, 25 Karen Avenue, Lambton Gardens, Germiston, Transvaal; Ian B. Reeves, Germiston, both of South Africa

[73] Assignee: Alan Paul Blakley Brown, Germiston, South Africa

[21] Appl. No.: 874,991

[22] Filed: Jun. 16, 1986

[30] Foreign Application Priority Data

Jun. 20, 1985 [ZA] South Africa ..... 85/4642

[51] Int. Cl.[4] ..... B22D 31/00

[52] U.S. Cl. ..... 164/264; 164/359; 164/140

[58] Field of Search ..... 164/359, 360, 264, 140, 164/70.1, 412

[56] References Cited

U.S. PATENT DOCUMENTS 4,131,152 12/1978 Ruddle et al. .

FOREIGN PATENT DOCUMENTS 216178 12/1984 German Democratic Rep. ..... 164/359

219404 3/1985 German Democratic Rep. ..... 164/359

1597832 9/1981 United Kingdom .

*Primary Examiner*—Nicholas P. Godici

*Assistant Examiner*—Samuel M. Heinrich

*Attorney, Agent, or Firm*—Spencer & Frank

[57] ABSTRACT

A breaker pad which is formed with a star-shaped orifice, with inwardly extending formations, which, when viewed from the side, are tapered, reducing in dimension towards the center of the orifice.

13 Claims, 3 Drawing Figures

BREAKER PAD

BACKGROUND OF THE INVENTION

This invention relates generally to the casting of materials and, more particularly, to a breaker pad used in certain casting operations.

Breaker pads are used in casting operations to provide some means for compensating for the contraction of the material being cast while it is cooling from a heated state. The use of a breaker pad leads to a reduction in material wastage and also makes it easier to separate unwanted material from the desired cast material.

SUMMARY OF THE INVENTION

It is an object of the present invention to provide an improved breaker pad.

The invention provides a breaker pad which is formed with an irregular orifice.

The word "irregular" in this specification is intended to mean an orifice with a suitable profile which generally speaking is not rectangular, square, round or oval.

The wall of the orifice may include at least one outwardly projecting formation. Preferably the projection is angular. In one form of the invention the wall of the orifice includes a plurality of outwardly projecting angular formations which extend generally towards each other. The number of the formations may vary according to the application but preferably is from 4 to 8. The orifice may take on any suitable shape and may for example be star-shaped.

In one form of the invention each formation is angular when viewed in a first direction which is substantially in line with the direction of material flow through the orifice, and when viewed from the side in a second direction which is substantially at right angles to the first direction.

Preferably each projection, when viewed from the side in a second direction, subtends an angle which lies between 50 degrees and 90 degrees.

A suitable angle is of the order of 62 degrees.

Thus in one form of the invention there is provided a breaker pad which is formed with an orifice, the boundary of which in plan includes a plurality of regions of angular profile which extend generally towards one another and the centre of the orifice.

As the breaker pad is formed with superheated regions which are not co-planar it follows that the total length or area of the superheated regions, depending on the basis of measurement used, may be extensive and may be considerably more than what is the case with other breaker pads known to the applicant. Consequently the size of the orifice may be reduced.

BRIEF DESCRIPTION OF THE DRAWINGS

The invention is further described by way of example with reference to the accompanying drawings in which.

DETAILED DESCRIPTION OF PREFERRED EMBODIMENT

Figure 1:
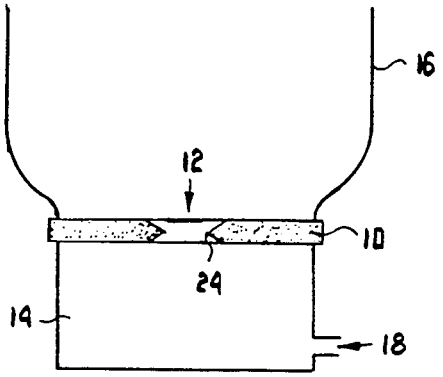
FIG. 1 is a schematic side view illustration the use of a conventional breaker pad.

FIG. 1 illustrates the manner of use of a conventional breaker pad. The breaker pad, designated 10, is formed with a central orifice 12 and is positioned over a mould 14 in a known way. A feeder or riser 16 is attached to the upper surface of the breaker pad 10. The mould 14 has an inlet 18 for the admission of a molten metal.

During a casting process a predetermined quantity of liquid metal is placed in the mould 14 through the inlet 18. The metal fills the mould and passes through the orifice 12 of the breaker pad 10 into the feeder or riser 16. As the metal in the mould 14 cools off it contracts and additional metal from the feeder 16 passes through the orifice 12 so as to maintain the metal inside the mould 14 at a desired level.

Figure 2:
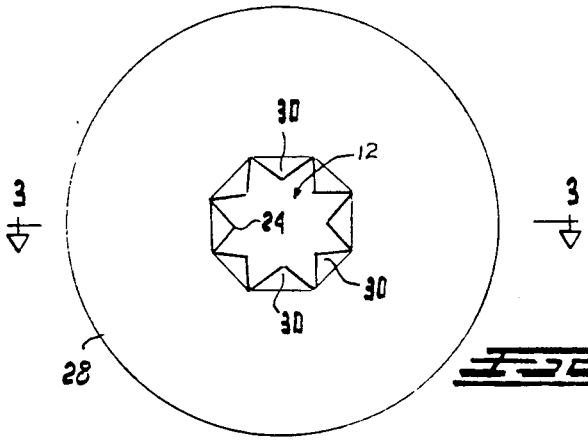
FIG. 2 is a plan view of a breaker pad according to one form of the invention.
Figure 3:
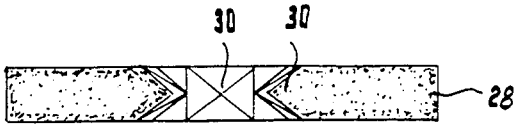
FIG. 3 is a cross-sectional view of the breaker pad of FIG. 2 taken on the line 3—3.

The orifice 12 is made as small as possible for, once the molten metal has solidified, it is necessary to detach the hardened waste metal still contained in the feeder from the desired cast metal contained in the mould. This is done by severing the two components through the neck contained with the orifice 12 of the breaker pad. It follows that the bigger the orifice the more difficult it is to detach the waste from the casting and, moreover, additional metal is wasted. Attempts have been made in the past to reduce the size of the orifice 12. However if the orifice is reduced by too large an extent then the metal solidifies in the orifice before it solidifies in the casting and the objective in making use of the feeder is not achieved. One attempt, which has resulted in a considerable reduction of the orifice size, made use of a circular orifice formed with, in cross section, a tapered side wall. This is shown in FIG. 1. The tapering of the side wall in the manner illustrated forms a ridge 24 which, in use, becomes superheated by the molten material and in this way the likelihood of the metal within the orifice solidifying, before the metal of the casting solidifies, is minimized. FIGS. 2 and 3 illustrate a breaker pad 28 according to the invention which permits the size of the orifice to be further reduced. In accordance with the invention the wall of the orifice is formed with a plurality of outwardly projecting angular formations which extend generally towards each other, and which form non-planar regions which are superheated in use. It should be observed, by way of contrast, that in the breaker pad of FIG. 1 the ridge 24, which becomes superheated in use, lies in one plane and consequently, its length is limited by the size of the orifice.

In the present invention however, as the orifice is formed with a plurality of regions (angular formation), each designated 30, of angular profile which extend inwardly towards the orifice centre or centre region, the length of the superheated region is considerably extended. As shown in FIG. 2, each pair of adjacent regions 30 have therebetween an angular recess or recess portion of the orifice, the angular formations and the angular recesses having surfaces converging respectively toward and away from the centre region to apical regions terminating at apex points. The configuration in this case is such that the orifice has a star shape with eight points extending into the orifice.

FIG. 3 shows the breaker pad 28 of FIG. 2 in cross-section. It can be seen from FIG. 3 that each angular region 30 is substantially pyramidal and has four flat sides sloping away from the innermost point of the region. Thus each region 30 is tapered along axes which are at right angles to each other, i.e. coinciding with the direction of material flow through the orifice, and a direction at right angles thereto. The angle of the taper when viewed in the latter direction preferably lies between 50 degrees and 90 degrees with a suitable angle being about 62 degrees. This has been established, through use, as being particularly effective in preventing the metal solidifying in the orifice of reduced dimensions. Consequently the points of each region 30 and the boundary lines along which the tapered sides meet all form zones which in use are superheated. The total length or area of the superheated zones considerably exceeds the corresponding measurements of a conventional breaker pad of the kind described in connection with FIG. 1. Consequently the size of the orifice can be reduced and the wastage of material is further minimized. It has in fact been found with certain experimental castings that the waste material can be knocked off from the casting and that there is no need to resort to the use of standard cutting techniques to detach the waste from the casting.

Clearly the principles of the invention may be incorporated in breaker pads of a variety of shapes and forms. The essence of the invention lies in the fact that the superheated region is extended relatively to the superheated regions in conventional breaker pads. This is achieved by forming the orifice to an irregular shape, as hereinbefore defined, with a plurality of inwardly extending angular regions and this effect is increased by providing the angular regions with extremities which lie in different planes and which are superheated in use. Consequently the total length or area of the superheated regions may be extended considerably relatively to conventional breaker pads.

Breaker pads incorporating the inventive features described hereinbefore are all intended to fall within the scope of the present application irrespective of their shape or size.

We claim:

1. A breaker pad which is formed with an orifice through which, in use, material flows, the wall of the orifice, viewed in a first direction which is substantially in-line with the direction of material flow through the orifice, including a plurality of angular formations which extend generally towards a central region of the orifice, each respective pair of adjacent angular formations having between them an angular recess which extends generally away from the said central region of the orifice.

2. A breaker pad according to claim 1 wherein the number of angular formations is from 4 to 8 and the number of angular recesses is the same as the number of angular formations.

3. A breaker pad according to claim 2 wherein the orifice is substantially star-shaped.

4. A breaker pad as in claim 3, wherein viewed from a second direction perpendicular to said first direction, said angular formations are tapered with reducing dimensions toward said central region of the orifice.

5. A breaker pad according to claim 1 wherein each angular formation viewed from a second direction which is substantially at right angles to the first direction, is angular.

6. A breaker pad according to claim 5 wherein each angular formation, viewed from said second direction, subtends an angle which lies between 50 degrees and 90 degrees.

7. A breaker pad according to claim 6 wherein the subtended angle is about 62 degrees.

8. A breaker pad as in claim 1, wherein said orifice is substantially star-shaped.

9. A breaker pad as in claim 1, wherein each of said angular formations have, on all sides thereof facing said orifice, means for superheating the flow of a molten flowable material as the molten flowable material flows through the orifice past said boundary lines.

10. A breaker pad, comprising a breaker pad body having an orifice therethrough and through which a flowable material can flow in a flow direction, said body, viewed in a first direction which is substantially in-line with said flow direction, including a plurality of successively adjacent angular formations forming a boundary surrounding said orifice and which extend generally towards a central region of said orifice, each respective pair of adjacent ones of said angular formations having therebetween an angular recess portion of said orifice which extends generally away from said central region of said orifice.

11. A breaker pad comprising a breaker pad body having an orifice therethrough and through which a flowable material can flow in a flow direction, said body, viewed in a first direction which is substantially in-line with said flow direction, including a plurality of successively adjacent formations having respective surfaces defining a boundary surrounding said orifice, the respective surfaces of each of said formations generally converging toward a central region of said orifice to an apical region of the formation, each respective pair of adjacent ones of said formations having therebetween a recess portion of said orifice bounded by adjacent pairs of said surfaces generally converging away from said central region of said orifice to an apical region of the recess portion.

12. A breaker pad as in claim 11, wherein said formations generally converge toward said centrel region of said orifice to an apex point of the formation, each of said adjacent pairs of said surfaces generally converging away from said central region of said orifice to an apex point of the recess portion.

13. A breaker pad as in claim 12, wherein viewed from a second direction perpendicular to said first direction, said angular formations are each tapered on sides thereof with reducing dimensions toward said central region of the orifice so as to define means at boundary lines between said sides for superheating the flow of a molten flowable material as the flowable material flows through the orifice past said boundary lines.

* * * * *